US009108460B2

(12) United States Patent
Hall

(10) Patent No.: US 9,108,460 B2
(45) Date of Patent: Aug. 18, 2015

(54) SUPPORT FRAME FOR CANVAS AND THE LIKE

(71) Applicant: Stephen Taylor Hall, Frederick, MD (US)

(72) Inventor: Stephen Taylor Hall, Frederick, MD (US)

(73) Assignee: Stephen T. Hall and Linda J. Hall, as tenants by the entireties, Frederick, MD (US)

( * ) Notice: Subject to any disclaimer, the term of this patent is extended or adjusted under 35 U.S.C. 154(b) by 0 days.

(21) Appl. No.: 14/459,349

(22) Filed: Aug. 14, 2014

(65) Prior Publication Data

US 2014/0352184 A1 Dec. 4, 2014

Related U.S. Application Data

(60) Provisional application No. 61/872,444, filed on Aug. 30, 2013.

(51) Int. Cl.

| | |
|---|---|
| ***B44D 3/18*** | (2006.01) |
| ***G09F 15/00*** | (2006.01) |
| *D06C 3/08* | (2006.01) |

(52) U.S. Cl.

CPC *B44D 3/185* (2013.01); *D06C 3/08* (2013.01); *G09F 15/0012* (2013.01); *G09F 15/0025* (2013.01)

(58) Field of Classification Search

CPC ..... D06F 59/08; B44D 3/185; G09F 15/0025; G09F 1/12; B41F 15/34; B41F 15/36; B41F 15/38; D06C 3/08

USPC ..... 38/102.1, 102.91; 160/374.1, 378; 101/127.1

See application file for complete search history.

(56) References Cited

U.S. PATENT DOCUMENTS

| | | | | |
|---|---|---|---|---|
| 3,211,089 | A * | 10/1965 | Messerschmitt | 101/127.1 |
| 3,422,554 | A * | 1/1969 | Prinzhorn | 38/102.1 |
| 3,978,905 | A * | 9/1976 | de Lama et al. | 160/378 |
| 4,144,660 | A | 3/1979 | Lamb | |
| 5,033,216 | A * | 7/1991 | Gandy et al. | 40/603 |
| 5,133,140 | A * | 7/1992 | Frey | 38/102.91 |
| 5,502,906 | A | 4/1996 | Yamawaki | |
| 5,992,070 | A * | 11/1999 | Birnbaum | 40/603 |
| 6,253,471 | B1 * | 7/2001 | Strauh | 38/102.1 |
| 6,269,569 | B1 | 8/2001 | Doone | |
| 6,674,510 | B1 | 1/2004 | Jasper et al. | |
| 6,675,510 | B2 | 1/2004 | Ocampo | |
| 6,983,524 | B2 | 1/2006 | Eastwood | |
| 2006/0010729 | A1 | 1/2006 | Liu | |

* cited by examiner

*Primary Examiner* — Ismael Izaguirre

(74) *Attorney, Agent, or Firm* — Patentfile, LLC; Bradley C. Fach; Steven R. Kick

(57) ABSTRACT

A novel display surface framing and support apparatus capable of temporarily or permanently securing canvas art and other substrates in a taunt manner without damaging the display surface. Upon assembly, the structural members join in a self-squaring fashion creating a square or rectangular frame. In preferred embodiments, the framing and support apparatus generally comprises four frame members which are substantially three sided in profile, and four corner joiners that are inserted into the ends of each frame member and being secured with a plurality of fastening means. The periphery of the display surface wraps over and around the frame members and is secured into a securement groove that is continuous along each frame member. In some embodiments, a spline element may be used to press the display surface into the securement groove of each frame member to thereby fix the display surface to the apparatus in a taunt fashion.

17 Claims, 7 Drawing Sheets

SUPPORT FRAME FOR CANVAS AND THE LIKE

CROSS REFERENCES TO RELATED APPLICATION

The present application claims priority to U.S. provisional patent application No. 61/872,444 filed Aug. 30, 2013, and entitled "NOVEL CANVAS FRAMING APPARATUS" the entire contents of the above-referenced patent application is incorporated by reference herein.

FIELD OF THE INVENTION

The present invention relates to the field of support frames used for paintings or photographs and other items for display.

BACKGROUND

Canvas has been a preferred medium of painters and artists for centuries. Traditionally, mounting a canvas to a frame required a great amount of time and effort. Assembling the frame so that it was squared, and then fastening the stretched canvas over the frame could be considered an art form in and of itself. Most frames are built from wood which has many drawbacks. Wood contracts and expands over time resulting in the continual sagging and retightening of canvas stretched over wooden frames which causes the painting to crack and chip requiring costly restoration.

In an attempt to overcome these drawbacks, some related frames have been made out of aluminum, plastic, or other manmade materials. U.S. Pat. No. 6,983,524 filed on Mar. 12, 2003, by Eastwood et al, describes an aluminum frame that is welded together. The canvas is applied onto the frame and attached with staples or other similar means. While the aluminum frame prevents expansion and contraction, the method of attaching the canvas to the frame is inadequate and may result in damage to the canvas.

To prevent damage to the canvas caused by the attachment means listed above, some related frames have employed bracket mechanisms. U.S. patent application Ser. No. 11/160,356 filed Jun. 21, 2005 by Hsiang-Chuan Liu et al. describes a nail-free interchangeable canvas frame system. The disclosed frame uses complex brackets that expand and press the canvas into the corners of the frame, eliminating damage caused by staples, nails, and similar attachment means. This system requires mastering the complex bracket assembly process and consumes a significant amount of time to construct.

Some other types of frames have attempted to simplify the canvas mounting process. U.S. Pat. No. 6,675,510 filed May 7, 2002, by Ocampo et al. describes a fabric gripping and stretching system that utilizes a plurality of linear gripping members that are attached to the four sides of the canvas. The gripping members are then inserted into receptive channels on the four sides of the frame, thereby securing the canvas to the device. This system requires careful alignment and attachment of the gripping members to the canvas which ultimately damages the canvas and requires a significant amount of time.

Therefore, a need exists for novel systems and apparatuses for framing canvas commonly used in the painting and art industry, which are made from a material that will not expand and contract over time. It is a further need for the framing system to be able to secure canvases without causing damage even with repeated mountings and unmountings. It is still a further need for the faming system to be easily and quickly assembled and also for the canvas to be mounted and unmounted to a wall or support structure in an easy and quick manner.

BRIEF SUMMARY OF THE INVENTION

The present invention comprises a novel framing and support apparatus capable of temporarily or permanently securing a display surface such as canvas art or other substrates in a taunt manner and without damaging the canvas. Upon assembly, the structural members join in a self-squaring fashion creating a square or rectangular frame. In preferred embodiments, the framing and support apparatus generally comprises four frame members which are substantially three sided in profile, and four corner joiners that are inserted into the ends of each frame member and being secured with a plurality of fastening means. The periphery of the display surface wraps over and around the frame members and is secured into a grove that is continuous along each frame member. In some embodiments, a spline element may be used to press the canvas into the securement groove of each frame member to thereby fix the canvas or display surface to the frame in a taunt fashion.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New framing apparatuses are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
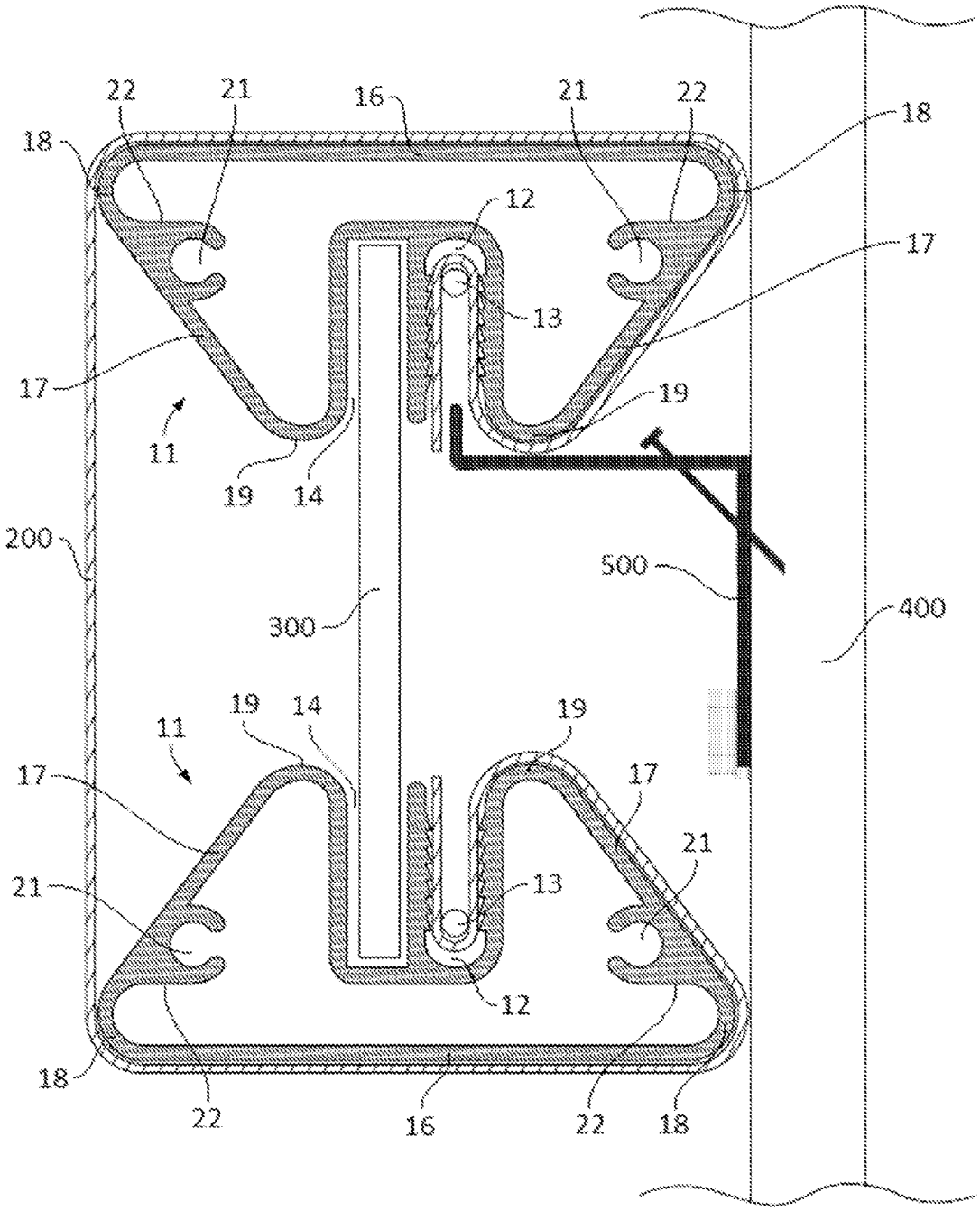
FIG. 1 depicts a sectional elevation view of an example of a framing and support apparatus securing a display surface according to various embodiments described herein.

The present invention will now be described by example and through referencing the appended figures representing preferred and alternative embodiments. FIG. 1 depicts a sectional, through line 1-1 shown in FIG. 7, elevation view of an example of a framing and support apparatus ("the apparatus") 100 (FIG. 7) securing a display surface 200 according to various embodiments described herein. In this example, the front of the display surface 200 is facing out and away from a vertical surface 400 such as a wall or other structure. An upper frame member 11 and lower frame member 11 of the framing apparatus 100 (FIG. 7) are depicted. The display surface 200 is pulled taunt over the upper frame member 11 and lower frame member 11 and may be secured into a securement groove 12 on each frame member 11. In some embodiments, the display surface 200 may preferably be secured in place by one or more pieces of spline 13. The spline 13 may be made from rubber, silicon, rope, or any other suitable material.

In this embodiment, the frame members 11 also comprise an optional brace channel 14 configured to accept and secure one or more optional brace members 300. The one or more optional brace members 300 may be a solid bar or rod made from a metal such as aluminum, wood, or any other suitable rigid material. In other embodiments, and as shown by subsequent figures, a framing member 11 may not comprise a brace channel 14 and the framing and support apparatus 100 (FIG. 7) may not comprise an optional brace member 300.

As shown by FIG. 1, the frame members 11 are generally triangular in shape or three sided in a sectional elevation view with a frame base 16 and a first and second angled sides 17 comprising the three sides of the triangular shape. The frame base 16 is joined to two outer support lips 18 with first and second angled sides 17 also joined to each of the outer support lips 18. A securement groove 12 and an optional brace channel 14 are disposed between the two angled sides 17. An inner support lip 19 joins each angled side 17 with a securement groove 12 and/or a brace channel 14. A screwboss 21 may be joined to an angled side 17, and in some embodiments, the screwboss 21 may also be joined to a corner joiner retainer 22.

In preferred embodiments, a display surface 200 such as canvas may be secured to a first frame member 11 by having a portion of the display surface 200 inserted into the securement groove 12 and secured therein with spline 13. The display surface 200 may wrap around an inner support lip 19, over and optionally contacting an angled side 17, and around an outer support lip 18 of the first frame member 11. Next, the display surface 200 may then pass over the frame base 16, around another outer support lip 18 of the first frame member 11, and then to the outer support lip 18 of the second frame member 11. Finally, the display surface 200 may wrap around an outer support lip 18 of the second frame member 11, over and optionally contacting an angled side 17 of the second frame member 11, around an inner support lip 19, and then into a securement groove 12 of the second frame member 11. Other types of display surface securing mechanisms in addition to the utilization of spline 13 and securement groove 12 are contemplated herein. By way of example, canvas may be secure to frame member 11 by adhesive, staples, tacks, nails, or other types of fasteners. In some embodiments, a display surface 200 may be made from fabrics, papers, flexible or rigid materials such as but not limited to; aluminum, wood, or Masonite. In the embodiments where a rigid material such as wood or Masonite are employed as a display surface 200, the securement groove 12 and optionally ridges 27 within the securement groove 12 may hold the display surface 200 securely inside the frame member 11 using frictional forces without spline 13.

The apparatus 100 (FIG. 7) may be supported on a vertical surface 400 by a nail, hook, or other wall fastener 500 which may be inserted into the vertical surface 400 and upon which an inner support lip 19, a hanger slot 25 (FIGS. 5-7), and/or securement groove 12 of a frame member 11 may rest. Of particular interest, a new type of wall fastener 500 is shown which generally comprises a horizontal surface connected at a 90 degree angle to a vertical surface.

A spline tool (not shown) may be used to install spline 13 into the securement groove 12. Spline installation tools are known in the art and may comprise a hand tool with a wheel or blunt end configured to put pressure on the spline 13 as it is being worked into the groove 12.

Figure 2:
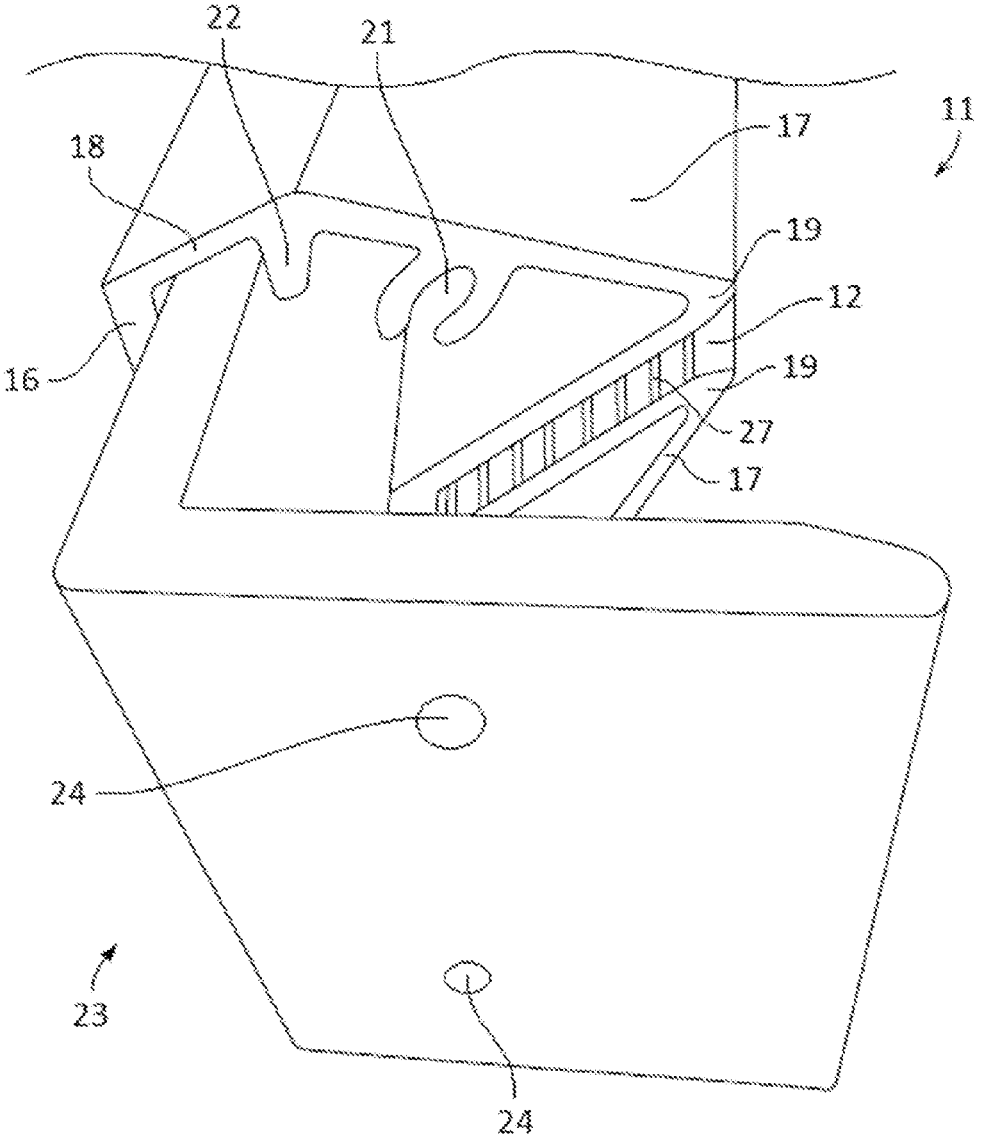
FIG. 2 illustrates a perspective view of an example of a frame member engaged to a corner joiner according to various embodiments described herein.

FIG. 2 illustrates a perspective view of an example of a frame member 11 engaged to a corner joiner 23 according to various embodiments described herein, thereby providing a method of attaching two side frame members 11 of a framing and support apparatus 100 (FIG. 7) together at a generally 90 degree or right angle. In preferred embodiments, two frame members 11 may be attached together forming a generally 90 degree or right angle with one generally L shaped corner joiner 23 and two or more frame fasteners 26 (FIG. 7) such as screws, bolts, or any other suitable fastener. A corner joiner 23 may be inserted into the space within a frame member 11 bounded by the two corner joiner retainers 22 and the frame base 16. Once the corner joiner 23 is inserted into both frame members 11, two frame fasteners 26 may be inserted through fastener apertures 24 on the frame base 16 of one frame member 11, through two fastener apertures 24 on a corner joiner 23, and into the screwbosses 21 of the second frame member 11 thereby attaching two frame members 11 together in a generally 90 degree or right angle. In this embodiment, the outer support lips 18 and inner support lips 19 comprise a generally angular shape.

Figure 3:
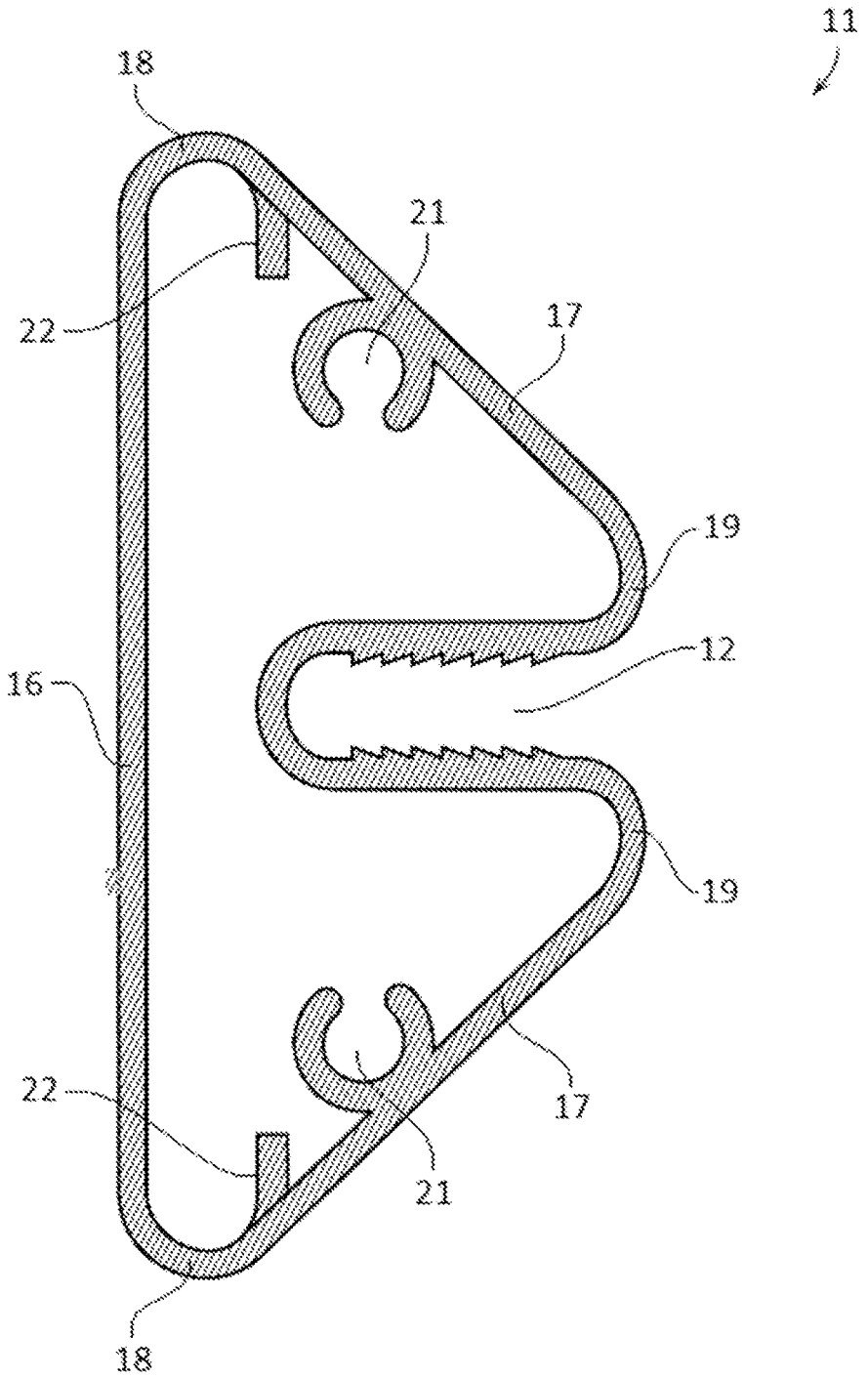
FIG. 3 shows a sectional elevation view of an example of a framing member according to various embodiments described herein.

In the embodiments depicted in FIGS. 2 and 3, a frame member 11 may comprise two corner joiner retainers 22, and a corner joiner 23 may be inserted into the space within a frame member 11 bounded by the two corner joiner retainers 22 and the frame base 16. In other embodiments, such as shown in FIGS. 1, 4-6 a frame member 11 may comprise a securement groove 12 and/or a brace channel 14 that extends to the same plane as the corner joiner retainers 22, and a corner joiner 23 may be inserted into the space within a frame member 11 bounded by the two corner joiner retainers 23, the frame base 16, a securement groove 12, and/or a brace channel 14.

Figure 7:
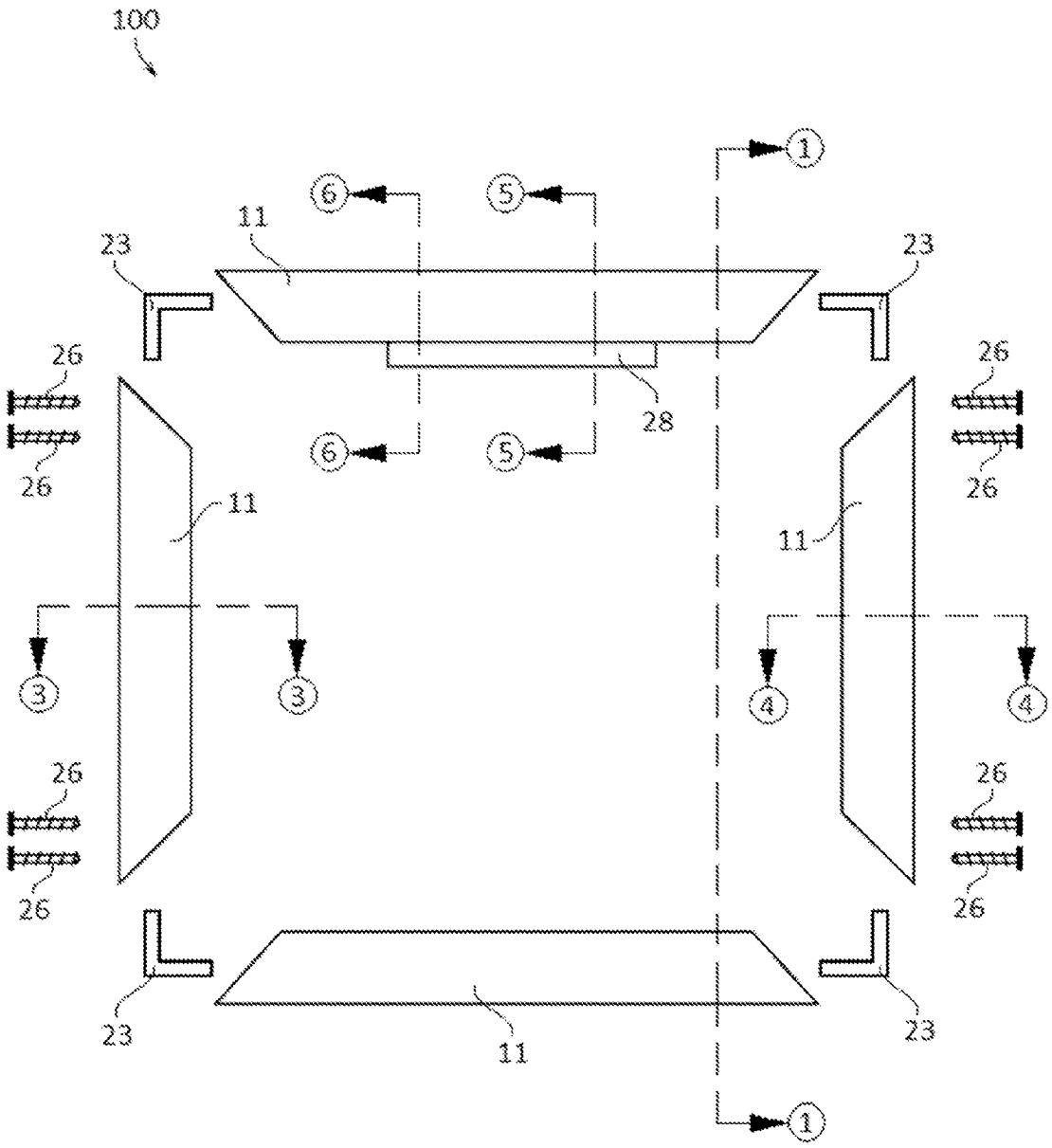
FIG. 7 depicts a plan view of the front of an example of a framing and support apparatus according to various embodiments described herein.

In preferred embodiments, a right frame member 11 (FIG. 7) and a left frame member 11 (FIG. 7) comprise fastener apertures 24 into which the frame fasteners 26 (FIG. 7) are inserted into and mate with the screw bosses 21 of the upper frame member 11 (FIG. 7) and lower frame member 11 (FIG. 7). In other embodiments, the upper frame member 11 (FIG. 7) and the lower frame member 11 (FIG. 7) comprise fastener apertures 24 into which the frame fasteners 26 are inserted into and mate with the screw bosses 21 of the right frame member 11 (FIG. 7) and left frame member 11 (FIG. 7). In further embodiments, all of the frame members 11 may comprise a fastener aperture 24 capable of receiving a frame fastener 26.

Turning now to FIG. 3, a sectional, through line 3-3 shown in FIG. 7, elevation view of an example of a framing member 11 according to various embodiments described herein is shown. In this alternative preferred embodiment and the embodiments depicted in FIGS. 1, 3, and 4, the frame member 11 also comprises a generally triangular or three sided shape in sectional elevation with a frame base 16, a first angled side 17, and a second angled side 17 together forming the three sides of the triangular shaped frame member 11 when viewed in a sectional elevation. In this example, the frame base 16 is joined to two outer support lips 18 with an angled side 17 also joined to each of the two outer support lips 18. A securement groove 12 is disposed between the two angled sides 17, and an inner support lip 19 joins each angled side 17 with the securement groove 12. In embodiments 1 and 3-6, the outer support lips 18 and inner support lips 19 comprise angular generally rounded shape. A screwboss 21 may be joined to an angled side 17, and a corner joiner retainer 22 may be joined to an outer support lip 18 and/or an angled side 17.

Figure 4:
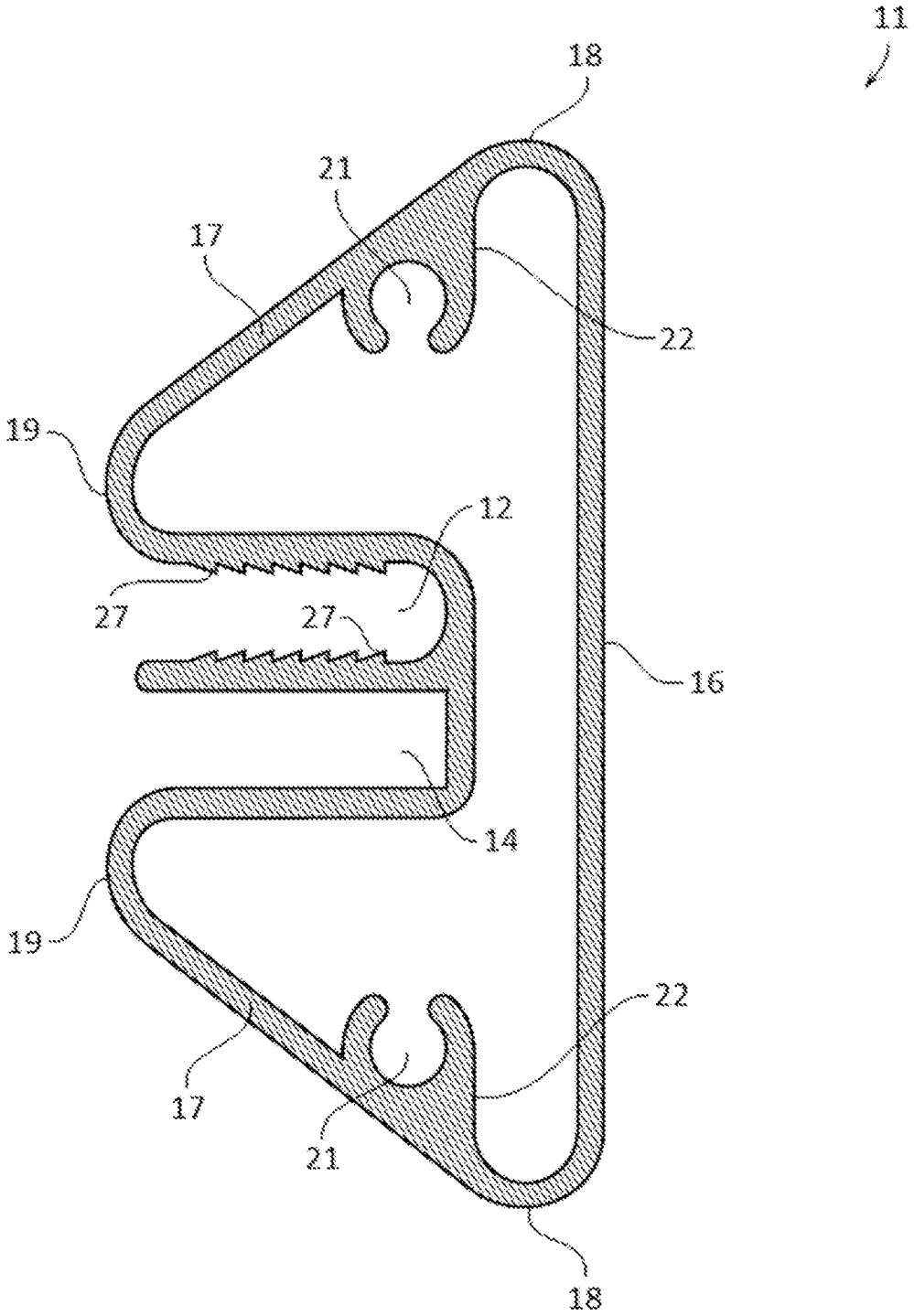
FIG. 4 depicts a sectional elevation view of an example of a framing member according to various embodiments described herein.

FIG. 4 depicts a sectional, through line 4-4 shown in FIG. 7, elevation view of an example of a framing member according to various embodiments described herein. In this embodiment, the securement groove 12 comprises a plurality of spline ridges 27 which are preferably angled towards the interior of a securement groove 12 to provide frictional resistance to the removal of spline 13 (FIG. 1) or in some cases a rigid support member 200 from the securement groove 12. In other embodiments, one or more spline ridges 27 of various sizes, shapes, and textures may be positioned on the interior of a securement groove 12 to prevent a spline 13 and any display surface 200 (FIG. 1) it may be securing to a frame member 11 from slipping out of a securement groove 12.

Also depicted in FIG. 4 and in preferred embodiments, the cross sectional structure of the frame members 11 comprises a substantially three sided triangular shape, in profile, with outer support lips 18 and inner support lips 19 each configured with rounded corners that prevent damage to the mounted display surface 200 (FIG. 1). Also shown by the examples in the figures, at least one angled side 17 of each frame member 11 is angled relative to the frame base 16. In preferred embodiments, said angle is about 45 degrees between an angled side 17 relative to the frame base 16 of the frame member 11. In other embodiments, the angle may be between 45 to 85 degrees.

In further preferred embodiments, the frame members 11 are made of metal such as extruded aluminum or aluminum alloys, or any other suitable extrudable metal alloy. Due to the continuous nature of extruded material designs, the securement groove 12, brace channel 14, frame base 16, angled side 17, outer support lip 18, inner support lip 19, screwboss 21, corner joiner retainer 22, hanger slot 25 (FIGS. 5-7), and/or a spline ridge 27 may be continuous along the full length of the frame members 11. In other embodiments, the frame members 11 may be made from plastic, other metals, or any other suitable material common in the art of frames.

The elements of a frame member 11 may be joined together with heat bonding, chemical bonding, adhesives, clasp type fasteners, clip type fasteners, rivet type fasteners, threaded type fasteners, other types of fasteners, by being integrally molded or formed together, or any other suitable joining method capable of substantially permanently securing portions of a securement groove 12, brace channel 14, frame base 16, angled side 17, outer support lip 18, inner support lip 19, screwboss 21, corner joiner retainer 22, hanger slot 25 (FIGS. 5-7), and/or a spline ridge 27 together with another element of a frame member 11.

Figure 5:
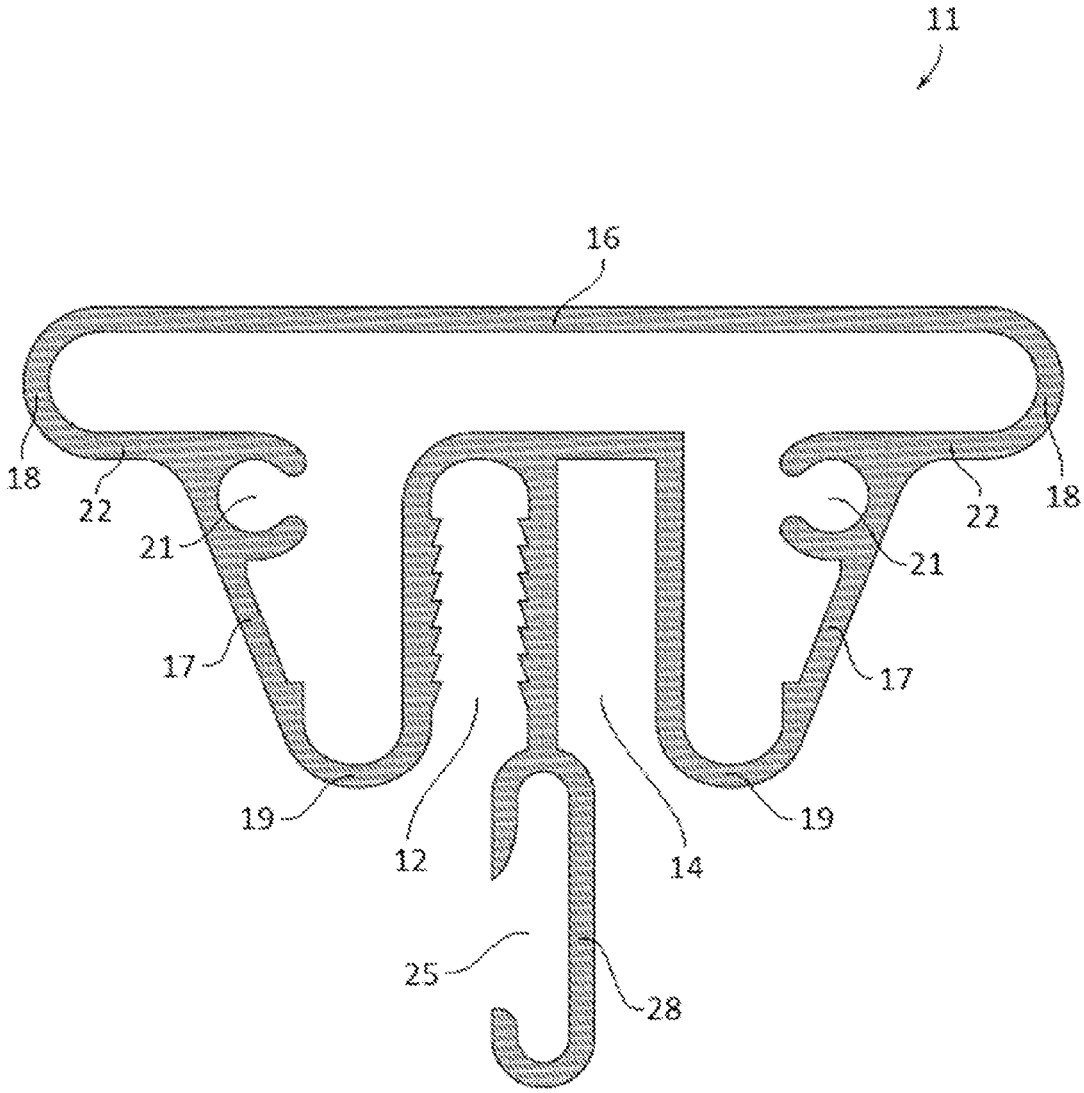
FIG. 5 illustrates a sectional elevation view of an example of a framing member according to various embodiments described herein.

As perhaps best shown by FIG. 5, which illustrates a sectional, through line 5-5 shown in FIG. 7, elevation view of an example of a framing member according to various embodiments described herein. In some embodiments, the frame members 11 may also comprise an optional hanger 28. The hanger 28 may comprise a hanger slot 25, fastener aperture 24 (FIG. 2), or any other opening which may be configured to accept one or more wall fasteners 500 (FIG. 1) allowing the framing and support apparatus 100 (FIG. 7) to be mounted to a wall or other vertical surface 400 (FIG. 1). A wall fastener 500 (FIG. 1) may comprise any wall mount or mounting device common in the art of picture hanging and mounting objects to vertical surfaces.

Figure 6:
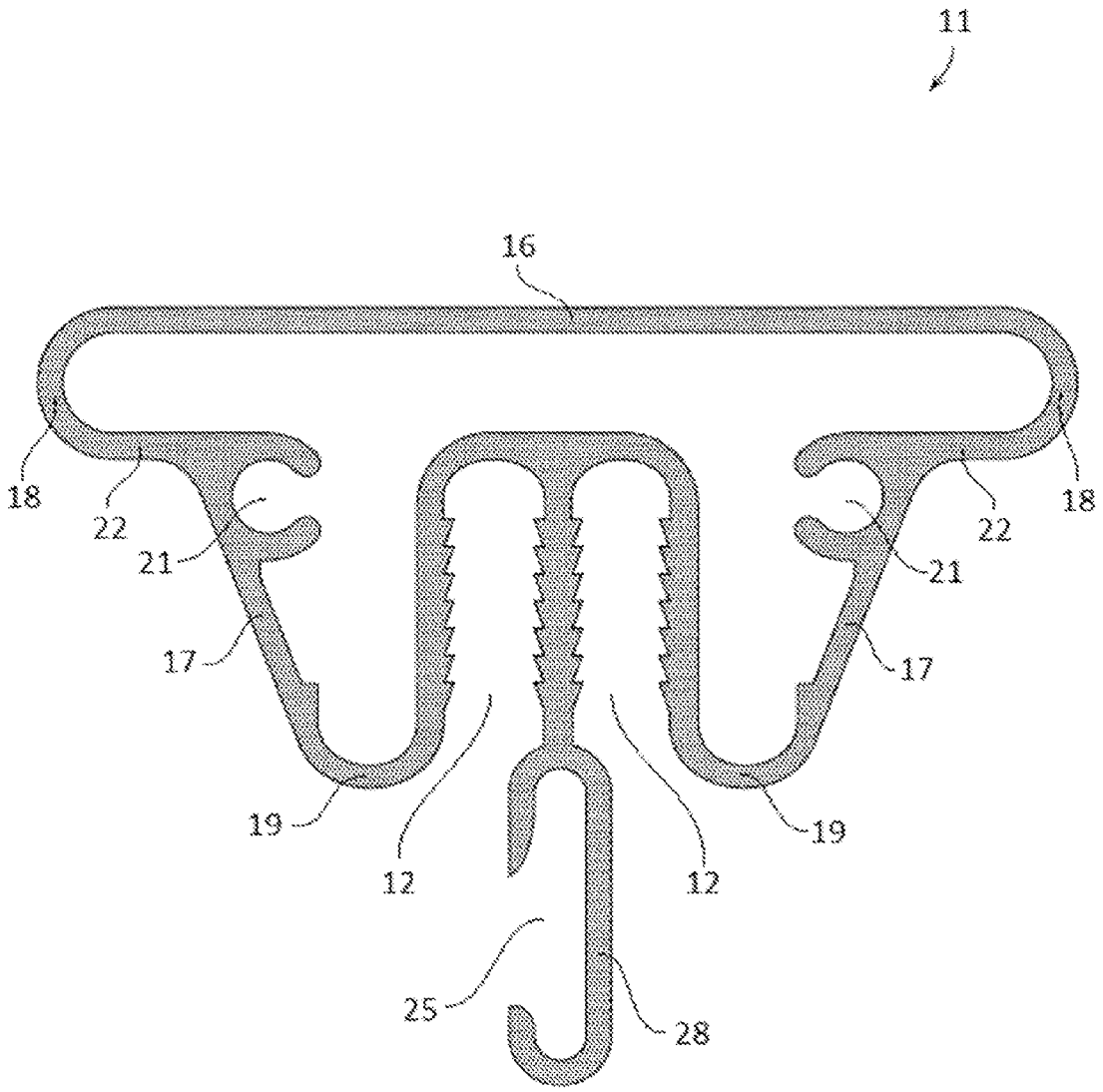
FIG. 6 shows a sectional elevation view of an example of a framing member according to various embodiments described herein.

FIG. 6 shows a sectional, through line 6-6 shown in FIG. 7, elevation view of an example of a framing member 11 according to various embodiments described herein. While frame members 11 comprise a securement groove 12, in this embodiment, a frame member 11 comprises a second securement groove 12. In other embodiments, a frame member 11 may comprise any number of securement grooves 12, spline ridges 27, screwbosses 21, brace channels 14 (FIGS. 1, 4, and 5), and/or hanger slots 25, each of which may extend continuously or discontinuously along the entire length or a portion of the length of a frame member 11.

FIG. 7 depicts a plan view of the front of an example of a framing and support apparatus 100 according to various embodiments described herein. It should be noted that cross sectional lines 1-1, 3-3, 4-4, 5-5, and 6-6 are provided and correspond to cross sectional views shown in FIGS. 1, 3, 4, 5, and 6 respectively. Although each of these cross sectional views may represent a different design embodiment of the frame member 11, it is likely that only a single frame member 11 design may be utilized in a single apparatus 100. Still referring to FIG. 7, in this illustration, a set of 4 frame members is used including an upper frame member 11 and lower frame member 11 may be joined at 90 degree angles with the right frame member 11 and the left frame member 11 to form a four sided square or rectangular frame. In other embodiments a set may include two frame members 11, three frame members 11, even five or more frame members 11 to form a 3-dimensional frame or artwork. In this example shown by FIG. 7, four corner joiners 23 and a plurality (e.g. eight) frame fasteners 26 are also shown. The apparatus 100 comprises frame members 11 each joined together and with a corner joiner 23 by one or more frame fasteners 26. The display surface 200 (FIG. 1) may be pulled taunt over the upper frame member 11, lower frame member 11, right frame member 11, and the left frame member 11 and may be secured into the securement groove 12 (FIGS. 1-6) of each frame member 11 with spline 13 (FIG. 1). The apparatus 100 may also comprise a frame member 11 which may further comprise a hanger 28.

The corner joiners 23 may be made from aluminum, metal alloy, plastic, wood or any other suitable material. In some embodiments, the framing apparatus 100 may comprise four or more frame fasteners 26. In preferred embodiments, the frame fasteners 26 comprise screw type fasteners such as Philips screws, flathead screws, Allen screws, or any other screw type fastener common in the art. In other embodiments, a frame fastener 26 may comprise bolts, nails, or any other fastener common in the art.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A support framing apparatus for the securement of a display surface, the apparatus comprising a set of support frame members with each frame member removably connected to each other and each frame member configured with a substantially pyramidal cross sectional shape and comprising:

a. a frame base with two opposite end regions and with a first end region terminating at a first outer support lip and a second end region terminating at a second outer support lip;

b. an first inner support lip and a second inner support lip spaced apart from the frame base;

c. a first inwardly angled side connecting the first outer support lip of the frame base to the a first inner support lip and a second inwardly angled side connecting the second outer support lip of the frame base to the second inner support lip; and d. a display surface securing mechanism located at the apex of the substantially pyramidal cross sectional shaped frame member between the first inner support lip and the second inner support lip.

2. The frame member of claim 1 wherein the display surface securing mechanism is a securement groove configured to accept a display surface and spline.

3. The frame member of claim 2 wherein the securement groove comprises spline ridges configured to secure spline and a display surface within the groove and provide frictional resistance against the spline unintentionally exiting the groove.

4. The frame member of claim 3 wherein a first frame member is removably connected to a second frame member through a corner joiner.

5. The coiner joiner of claim 4 wherein the corner joiner contains a fastener aperture configured to receive a fastener through the corner joiner and facilitate its transfer into the frame member.

6. The frame member of claim 4 wherein the frame base further comprises a corner joiner retainer configured to guide the acceptance and to frictionally secure a corner joiner within the body of the frame member and frame base.

7. The frame member of claim 4 further comprising a screw boss configured to accept a screw type fastener and secure a corner joiner to the frame member.

8. The frame member of claim 1 wherein an inner support lip is rounded.

9. A support framing apparatus for the securement of a display surface, the apparatus comprising a set of support frame members with each frame member removably connected to each other and each frame member comprising:

a. a substantially hollow frame base with two opposite end regions and with a first end region terminating in a first outer support lip;

b. a first inner support lip spaced apart from the frame base;

c. a first inwardly angled side connecting the first outer support lip of the frame base to the a first inner support lip;

d. a display surface securing mechanism located within the frame member wherein the display surface securing mechanism is a securement groove configured to accept a display surface and spline;

e. a second inwardly angled side connected to a second outer support lip of the frame base at one end and to a second inner support lip at a second end; said first and second inwardly sloped angled sides creating a substantially pyramidal cross sectional shaped frame member; and wherein the frame member further comprises a brace channel located adjacent to the securement groove and wherein the brace channel is configured to accept a frame support brace member.

10. The frame member of claim 9 wherein each frame member further comprises a corner joiner retainer configured to guide the acceptance and to frictionally secure a corner joiner within the body of the frame member.

11. The frame member of claim 10 further comprising a screw boss configured to accept a screw type fastener and secure a corner joiner to the frame member.

12. The frame member of claim 11 wherein an inner support lip is rounded.

13. A system for mounting a display surface in a frame, the system comprising:

a. providing a set of four frame members with each frame member having a substantially pyramidal cross sectional shape;

b. inserting one end of a corner joiner into a cavity located within a frame base of a first frame member;

c. inserting a second end of a corner joiner into a cavity located within a frame base of a second frame member;

d. securing the corner joiner to each of the frame members;

e. repeating step b and step c as need for additional frame members until a four sided frame is constructed; and f. securing a display surface to the frame members using a display surface securing mechanism positioned at the apex of said substantially pyramidal cross sectional shaped frame member and wherein the display surface securing mechanism is a securement groove configured to accept canvas and spline.

14. The system of claim 13 wherein the corner joiner is configured in an L-shaped configuration.

15. The system of claim 13 wherein each frame member further comprises a corner joiner retainer configured to guide the acceptance and to frictionally secure a corner joiner within the body of the frame member.

16. The system of claim 13 wherein each frame member further comprises a screw boss configured to accept a screw type fastener and secure a corner joiner to the frame member.

17. The system of claim 13 wherein the securement groove comprises spline ridges configured to secure spline and a display surface within the groove and provide frictional resistance against the spline unintentionally exiting the groove.

* * * * *